US007628152B2

(12) United States Patent
Patterson et al.

(10) Patent No.: US 7,628,152 B2
(45) Date of Patent: Dec. 8, 2009

(54) BREATHING REGULATOR WITH NONLINEAR POSITIVE PRESSURE SPRING

(75) Inventors: Jason M. Patterson, Monroe, NC (US); Samuel C. Shomstein, Charlotte, NC (US)

(73) Assignee: STI Licensing Corp., Beachwood, OH (US)

( * ) Notice: Subject to any disclaimer, the term of this patent is extended or adjusted under 35 U.S.C. 154(b) by 780 days.

(21) Appl. No.: 10/831,999

(22) Filed: Apr. 26, 2004

(65) Prior Publication Data

US 2004/0261794 A1 Dec. 30, 2004

Related U.S. Application Data

(60) Provisional application No. 60/465,356, filed on Apr. 25, 2003.

(51) Int. Cl.
*A62B 7/00* (2006.01)
*B63C 11/02* (2006.01)
*B63C 11/18* (2006.01)

(52) U.S. Cl. ..... 128/204.26; 128/204.18; 128/204.27; 128/205.24; 128/200.29; 128/207.12; 137/495; 137/908; 251/82; 251/83

(58) Field of Classification Search ..... 128/200.29, 128/201.11, 201.27, 205.24, 204.18, 204.26, 128/207.12; 137/908, 495; 251/82, 74; 124/65, 124/16; 606/182; 42/1.13, 54
See application file for complete search history.

(56) References Cited

U.S. PATENT DOCUMENTS 2,070,661 A * 2/1937 Hughes ..... 137/463
2,378,047 A * 6/1945 Strange ..... 137/505.46
2,500,357 A * 3/1950 Ives ..... 236/80 R
2,814,291 A * 11/1957 Holmes ..... 128/204.26
2,858,829 A * 11/1958 Gagnan ..... 128/204.26
3,973,588 A * 8/1976 Holst ..... 137/854
4,361,145 A 11/1982 Ekström et al. ..... 128/204.26
4,434,774 A * 3/1984 Horiuchi ..... 123/557
4,625,759 A * 12/1986 Craig ..... 137/613
4,640,277 A * 2/1987 Meyer et al. ..... 128/204.23
4,887,638 A * 12/1989 Hellquist et al. ..... 137/505.13
5,503,140 A * 4/1996 Winefordner et al. .. 128/200.29
6,176,239 B1 1/2001 Grove et al. ..... 128/206.24
6,729,331 B2 * 5/2004 Kay ..... 128/205.24
2003/0000529 A1 * 1/2003 Kay ..... 128/204.26

OTHER PUBLICATIONS

Handbook of Spring Design, Spring Manufactures Institute, Inc., 2002, pp. 3-4 and 49-76.*
U.S. Appl. No. 10/739,752, filed Dec. 18, 2003.
U.S. Appl. No. 60/485,211, filed Jul. 4, 2003.

* cited by examiner

*Primary Examiner*—Steven O Douglas
*Assistant Examiner*—Clinton Ostrup
(74) *Attorney, Agent, or Firm*—Rick Comoglio; Dean Small; The Small Patent Law Group

(57) ABSTRACT

A breathing regulator having a non-linear positive pressure spring is provided for use in an air supplied respirator. The regulator includes a housing formed from a regulator body and a cover sub-assembly, a diaphragm assembly, and the non-linear spring. The spring holds the diaphragm assembly closed and resists the force applied by air pressure during exhalation by the user, but collapses once a sufficient amount of force has been applied, thereby permitting the user to exhale freely.

20 Claims, 15 Drawing Sheets

10

39

BREATHING REGULATOR WITH NONLINEAR POSITIVE PRESSURE SPRING

CROSS-REFERENCE TO RELATED APPLICATION

This application is entitled to the benefit of, and claims priority to, provisional U.S. Patent Application Ser. No. 60/465,356 filed Apr. 25, 2003 and entitled "CBRN (CHEMICAL, BIOLOGICAL, RADIOLOGICAL AND NUCLEAR) REGULATOR," the entirety of which is incorporated herein by reference.

BACKGROUND OF THE PRESENT INVENTION

1. Field of the Present Invention

The present invention relates to an air supplied respiratory device, and, more particularly, to a breathing regulator having a non-linear positive pressure spring.

2. Background

A known respiratory device is the Self-Contained Breathing Apparatus (SCBA). SCBA's are commonly worn by individuals when carrying out activities in hazardous environments, such as when fighting fires and in other smoke- or gas-filled environments, in order to provide the wearer with breathable air. The SCBA is comprised of a number of assemblies including a cylinder and valve assembly for storing breathing air under pressure, a full facepiece assembly, one or more pressure reduction assembly including a breathing regulator, a harness and backframe assembly for supporting the equipment on the back of the wearer, and a remote gauge indicating cylinder pressure.

Although a number of standards and requirements with respect to such equipment have existed over the years, these standards and requirements continue to become more demanding. For example, the NFPA, an independent consensus group supplying advisory services, data collection, analysis and research services, all related to fire prevention and fire safety, established a standard in 1971 for Protective Equipment for Fire Fighters. In 1981, NFPA specified National Institute for Occupational Safety and Health (NIOSH)/Mine Safety and Health Administration (MSHA) approved Self-Contained Breathing Apparatus (SCBA) with a minimum rated service life of 30 minutes and open-circuit SCBA was required to be positive pressure. Open-circuit SCBA refers to a SCBA in which exhalation is vented to the atmosphere and not rebreathed. There are two types of open-circuit SCBA: negative pressure or demand type, and positive pressure or pressure demand type. Positive pressure SCBA was required after 1981 and is the type in which the pressure inside the facepiece, in relation to the pressure surrounding the outside of the facepiece, is positive during both inhalation and exhalation when tested by NIOSH in accordance with 42 CFR 84, Subpart H.

There are a number of other standards that exist with respect to air supply respirators. Another such established test procedure is the National Institute for Occupational Safety and Health (NIOSH) 42 CFR Part 84. Certification of an SCBA for use in chemical, biological, radiological and nuclear ("CBRN") environments is a function of NIOSH Approval of Respiratory Protective Devices. NIOSH is part of the U.S. Department of Health, Education & Welfare and establishes the basis for testing (i.e., flow rates, weight, etc.) and certification of respiratory equipment.

Another test standard is the European Standard, EN 137, entitled "Respiratory protective devices: self-contained open-circuit compressed air breathing apparatus." The European test standard's function is similar to the NFPA in the United States. It demonstrates that the need for effective respiratory equipment is a global concern.

One of the most critical assemblies of the SCBA is the breathing regulator, also commonly known as a second stage regulator. A function of the breathing regulator is to reduce the air pressure from the incoming supply hose to a pressure that is low enough (0 to 3.5 inches water column) to be breathable by a person. This pressure reduction creates a pressure drop from a reservoir of high pressure to a reservoir of low pressure, and modulates flow to the user.

Another function of the breathing regulator is to maintain a pressure inside a mask comprising a full facepiece assembly above the ambient pressure. Maintaining inside pressure prevents smoke or other contaminants encountered in an imminent danger to life and health ("IDLH") environment, such as carbon monoxide and the like, from entering the mask when a user is inhaling. Masks and/or regulators that are specially designed for use in CBRN environments may also be capable of preventing contaminants such as sarin (GB) or distilled sulfur mustard (HD) from entering the mask, but conventional (non-CBRN) masks may generally not be employed for that purpose. When a user exhales, the pressure inside the mask increases until a vent opens releasing expired air. Static pressure above ambient pressure is always maintained.

Exhalation pressure in conventional breathing regulators is generally approximately 2.5 inches water column. The lower the exhalation pressure, the easier it is for a user to exhale. Accordingly, lowering the exhalation pressure allows a user to breathe easier.

Many conventional breathing regulators make use of a spring or the like to maintain pressure within the mask. The spring biases the exhalation valve assembly closed. During inhalation, air is being drawn into the mask, and little or no force is exerted against the exhalation valve assembly, so the exhalation valve assembly remains closed. However, during exhalation, air pressure of the exhaled breath applies a force against the exhalation valve assembly. If the force is great enough to overcome the force applied by the spring, then the exhalation valve assembly is opened and exhaled breath is exhausted therethrough. Accordingly, in order to breathe out, a user must generally exhale with enough force to overcome the biasing force of the spring for a period of time long enough to complete the exhalation phase of the breathing cycle.

A significant drawback, however, to known prior art breathing regulators is the type of spring utilized thereby. Such regulators make use of a "linear"-type spring. The term "linear" as used in the context of the present invention means that the deflection of the spring is directly proportional to the force applied to the spring throughout the normal range of operation of the spring. Unfortunately, in order to keep the exhalation valve assembly open far enough to permit exhaled air to pass through the breathing regulator quickly enough to enable the user to breathe at a comfortable pace, the user must exhale strongly enough to generate a relatively high pressure in the regulator. This, in turn, requires a relatively high level of exertion on the part of the user in order to generate this pressure. Such exertion may not be comfortable for even the casual user, but the effort required to breathe is even more significant when the user is engaged in the elevated levels of physical activity common to many SCBA users.

Thus, the present invention intends to overcome the problems associated with the use of existing breathing regulator designs utilizing a linear spring, while at the same time successfully meeting the standards for respiratory equipment certification.

SUMMARY OF THE PRESENT INVENTION

The present invention relates to a breathing regulator utilizing a non-linear positive pressure spring to bias a diaphragm assembly in a closed or sealed position but which collapses or buckles when sufficient force is applied to the diaphragm assembly by way of air pressure created during the exhalation phase of a breathing cycle.

Broadly defined, the present invention according to one aspect is a breathing regulator including a housing; a diaphragm assembly disposed within the housing; and a non-linear positive pressure spring, operably connected between the diaphragm assembly and the housing and arranged to bias the diaphragm assembly in a closed or sealed position within the housing.

In features of this aspect, the non-linear positive pressure spring is arranged to maintain the diaphragm assembly in the closed or sealed position during the inhalation phase of a breathing cycle and to permit the diaphragm assembly to move to an open position when the air pressure achieved during the exhalation phase of the breathing cycle is sufficient to overcome the biasing force applied by the spring; the amount of force required to maintain the diaphragm assembly in an open position is less than the amount of force required to move the diaphragm assembly to the open position; the non-linear positive pressure spring is a coil spring arranged to collapse or buckle when a sufficient amount of force is applied thereto; the housing includes a mounting post on which one end of the spring is retained; movement of the sensing diaphragm from the closed or sealed position causes the spring to compress until a predetermined position is reached, at which point further movement of the sensing diaphragm causes the spring to collapse; the point at which further movement of the sensing diaphragm causes the spring to collapse is reached when a central region of the spring is displaced relative to the ends of the spring by an amount sufficient to cause the spring to begin to fall out of compression; the coil is connected between the diaphragm assembly and the housing and arranged such that the body of the coil includes a first bend near its interconnection with the housing and a second bend near its interconnection with the diaphragm assembly; the regulator further includes an air saver lever interconnected between one end of the spring and the diaphragm assembly; and the housing includes a cover sub-assembly and a regulator body.

The present invention according to another aspect is an air supplied respirator having a breathing regulator that includes a housing; a diaphragm assembly disposed within the housing; and a non-linear positive pressure spring, operably connected between the diaphragm assembly and the housing and arranged to bias the diaphragm assembly in a closed or sealed position within the housing.

In features of this aspect, the non-linear positive pressure spring is arranged to maintain the diaphragm assembly in the closed or sealed position during the inhalation phase of a breathing cycle and to permit the diaphragm assembly to move to an open position when the air pressure achieved during the exhalation phase of the breathing cycle is sufficient to overcome the biasing force applied by the spring; the amount of force required to maintain the diaphragm assembly in an open position is less than the amount of force required to move the diaphragm assembly to the open position; the non-linear positive pressure spring is a coil spring arranged to collapse or buckle when a sufficient amount of force is applied thereto; the housing includes a mounting post on which one end of the spring is retained; movement of the sensing diaphragm from the closed or sealed position causes the spring to compress until a predetermined position is reached, at which point further movement of the sensing diaphragm causes the spring to collapse; the point at which further movement of the sensing diaphragm causes the spring to collapse is reached when a central region of the spring is displaced relative to the ends of the spring by an amount sufficient to cause the spring to begin to fall out of compression; the coil is connected between the diaphragm assembly and the housing and arranged such that the body of the coil includes a first bend near its interconnection with the housing and a second bend near its interconnection with the diaphragm assembly; the regulator of the respirator further includes an air saver lever interconnected between one end of the spring and the diaphragm assembly; and the housing includes a cover sub-assembly and a regulator body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
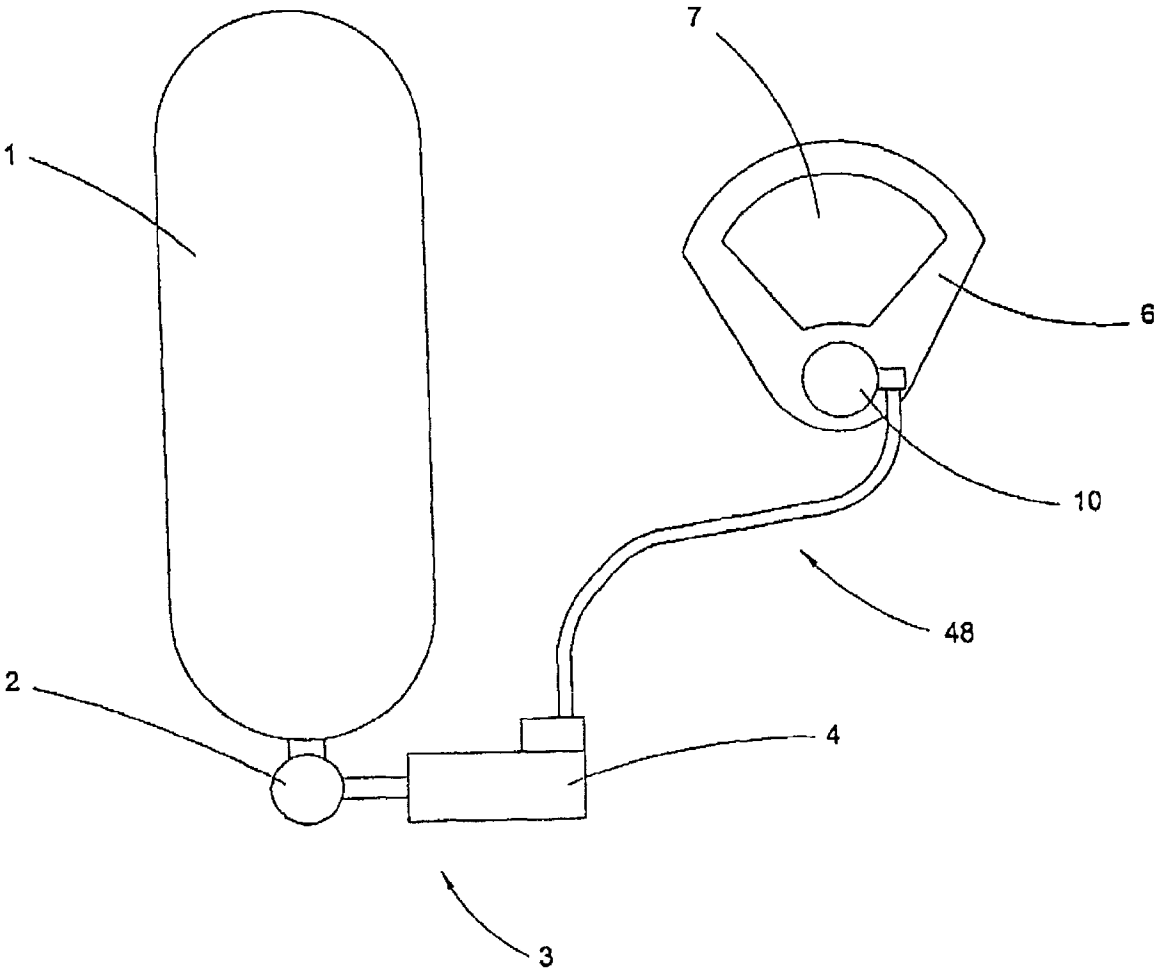
FIG. 1 is a block diagram of a self-contained breathing apparatus incorporating a breathing regulator, in accordance with the preferred embodiments of the present invention.

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a block diagram of a preferred embodiment of a self-contained breathing apparatus ("SCBA") carried by firefighters, military personnel, other emergency services workers, and the like. In this embodiment, the SCBA includes one or more pressure vessel 1, a valve 2, a first stage pressure reducer 4, a second stage pressure reduction assembly or breathing regulator 10, a facepiece 6, a transparent face shield 7, and a hose assembly 48. The pressure vessel 1 is a pressurized cylinder or tank that provides a supply of breathing gas to the wearer. Preferably, the tank 1 may be of a type that initially holds air at a pressure of about 316.4 kg/sq.cm. (4500 p.s.i.g.) or another standard capacity.

The hose assembly 48 is connected between the pressure reducer 4 and the facepiece 6 via the breathing regulator 10. The hose assembly 48 includes an air-supply hose and fittings suitable for connecting the pressure reducer 4 and the breathing regulator 10 such that they are in fluid communication with one another. The hose assembly 48 exist in many different configurations including, but not limited to, standard long hoses, Quick Disconnects, Beacon hoses, and Heads Up Display ("HUD") hoses. One HUD hose suitable for use with the preferred embodiments of the present invention is described in the commonly-assigned U.S. patent application Ser. No. 10/739,752, filed Dec. 18, 2003, the entirety of which is incorporated herein by reference. The design and implementation of other hoses will be apparent to one of ordinary skill in the art.

The breathing regulator 10 is preferably disposed on the facepiece 6, which covers the wearer's nose and mouth in airtight connection and preferably covers the wearer's eyes with the transparent shield 7 for external viewing. However, the breathing regulator 10 may be mounted elsewhere on the user's body or to an object, and the breathing regulator 10 may be connected by the hose assembly 48 to the rest of the SCBA.

In a preferred embodiment of the present invention, the first stage pressure reducer 4 and the valve 2 operate in combination as a valve and pressure reducer unit 3 and, more particularly, may be a quick connect valve and pressure reducer of the type disclosed in commonly-assigned U.S. Provisional Patent Application 60/485,211, filed Jul. 4, 2003, the entirety of which is incorporated herein by reference. The valve and pressure reducer unit 3 is disposed at the outlet of the tank 1 and in fluid communication therewith.

Figure 2:
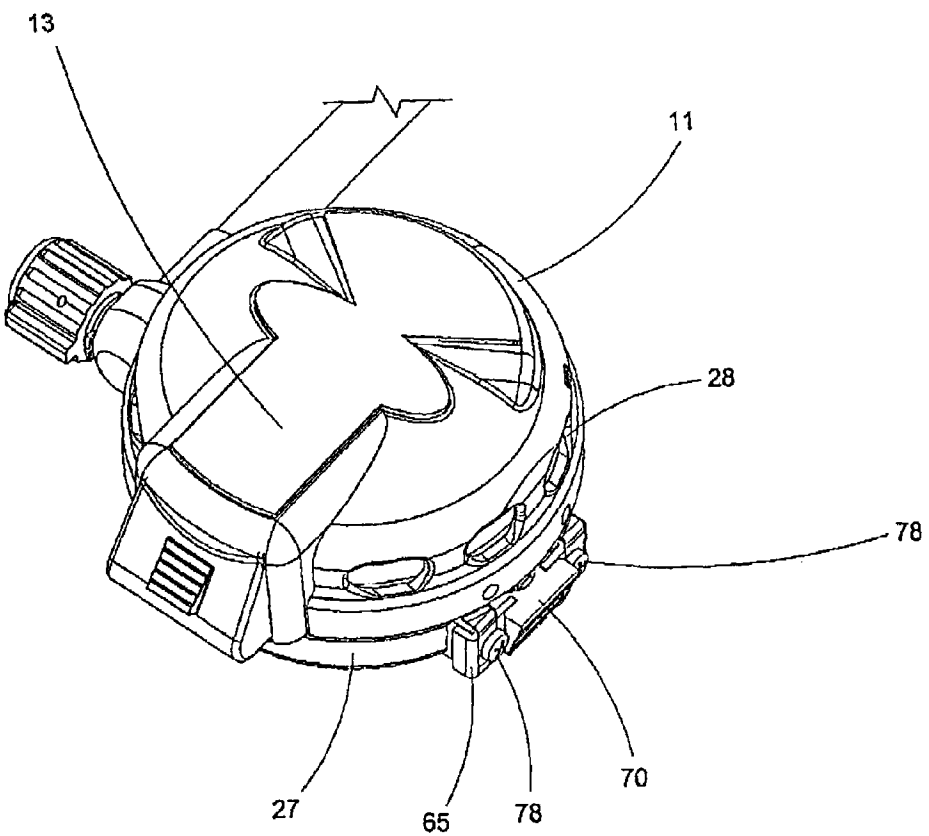
FIG. 2 is a front perspective view of the breathing regulator of FIG. 1.

FIG. 2 is a front perspective view of the breathing regulator 10 of FIG. 1, and FIGS. 3A, 3B, and 3C are left side, front, and right side plan views, respectively, of the breathing regulator 10 of FIG. 1. As shown in FIG. 2, the breathing regulator 10 includes a cover label 13, a regulator body 27, a cover sub-assembly 11 with one or more expired air port holes 28 through which expired air may exit, a latch plate 65, a regulator latch screw 78, and a regulator latch 70. Portions of the cover sub-assembly 11 and the regulator body 27 together form a housing in or on which most or all of the other components are supported.

Figures 3A, 3B, 3C:
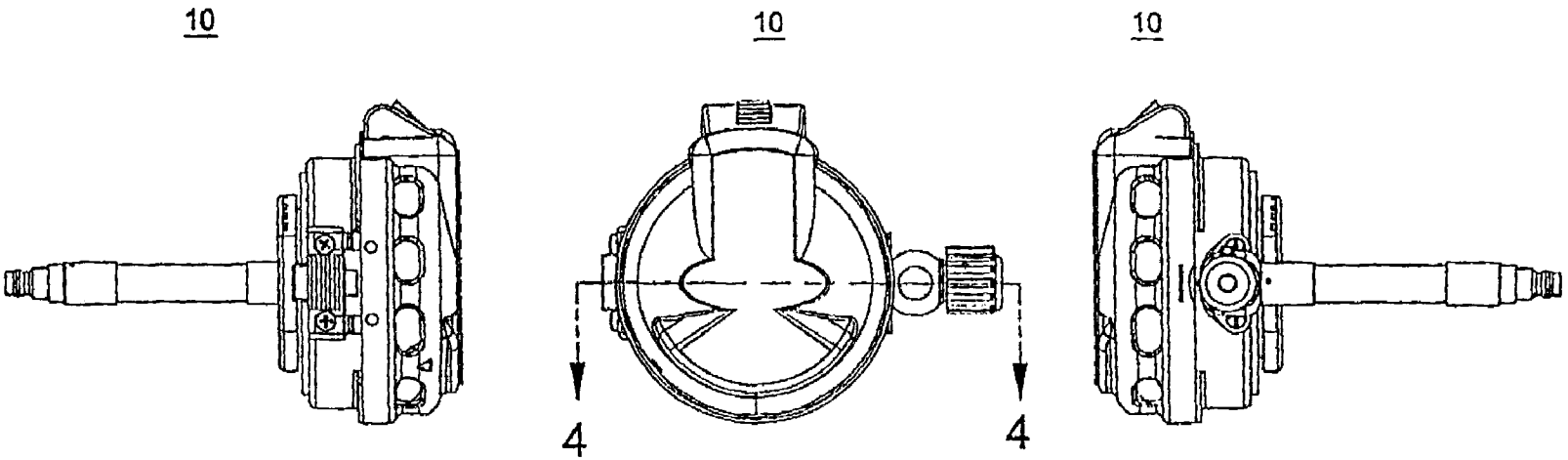
FIG. 3A is a left side plan view of the breathing regulator of FIG. 2.
FIG. 3B is a front plan view of the breathing regulator of FIG. 2.
FIG. 3C is a right side plan view of the breathing regulator of FIG. 2.
Figure 4:
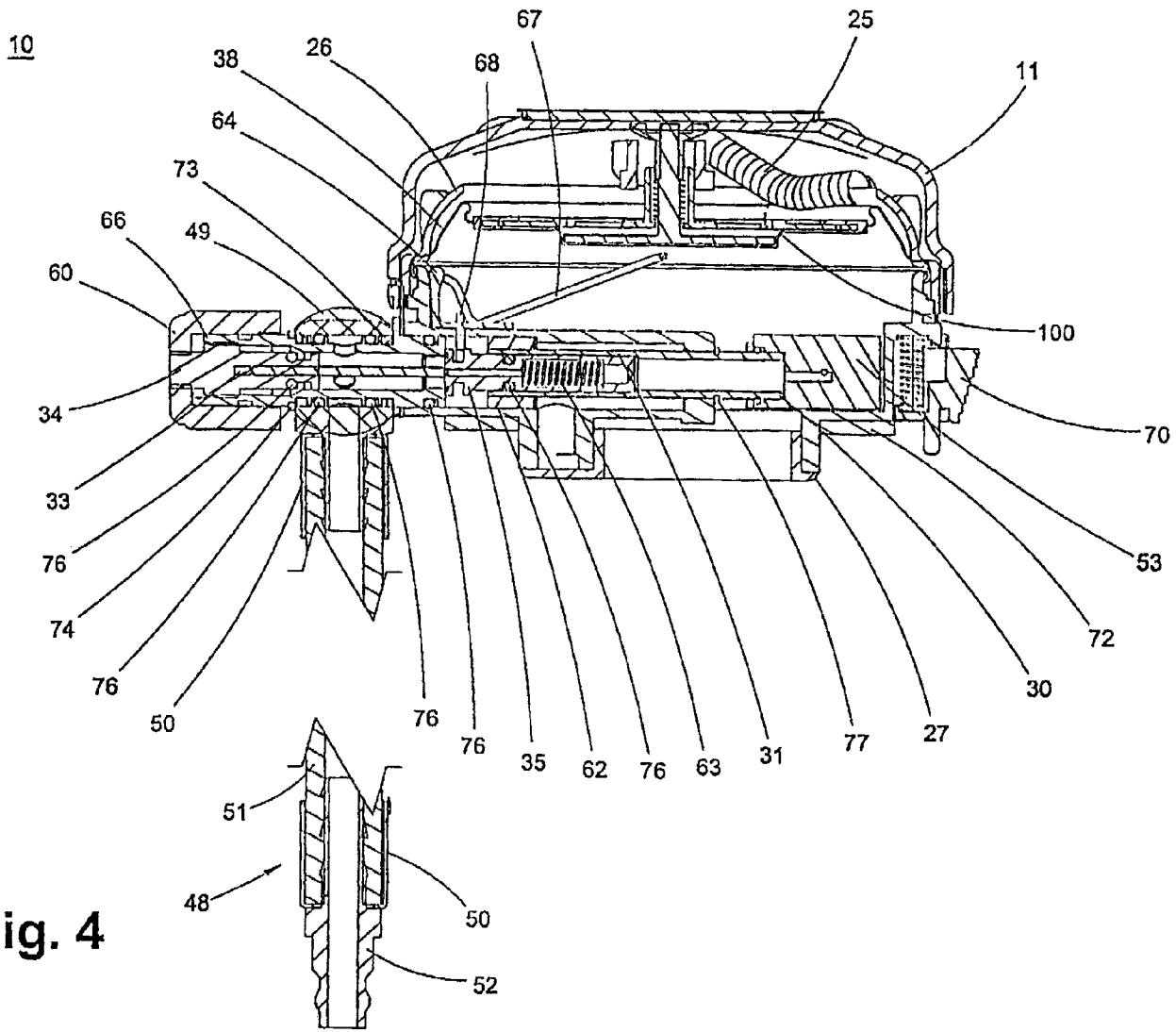
FIG. 4 is a top cross-sectional view of the breathing regulator of FIG. 3B, taken along line 4-4.
Figure 5:
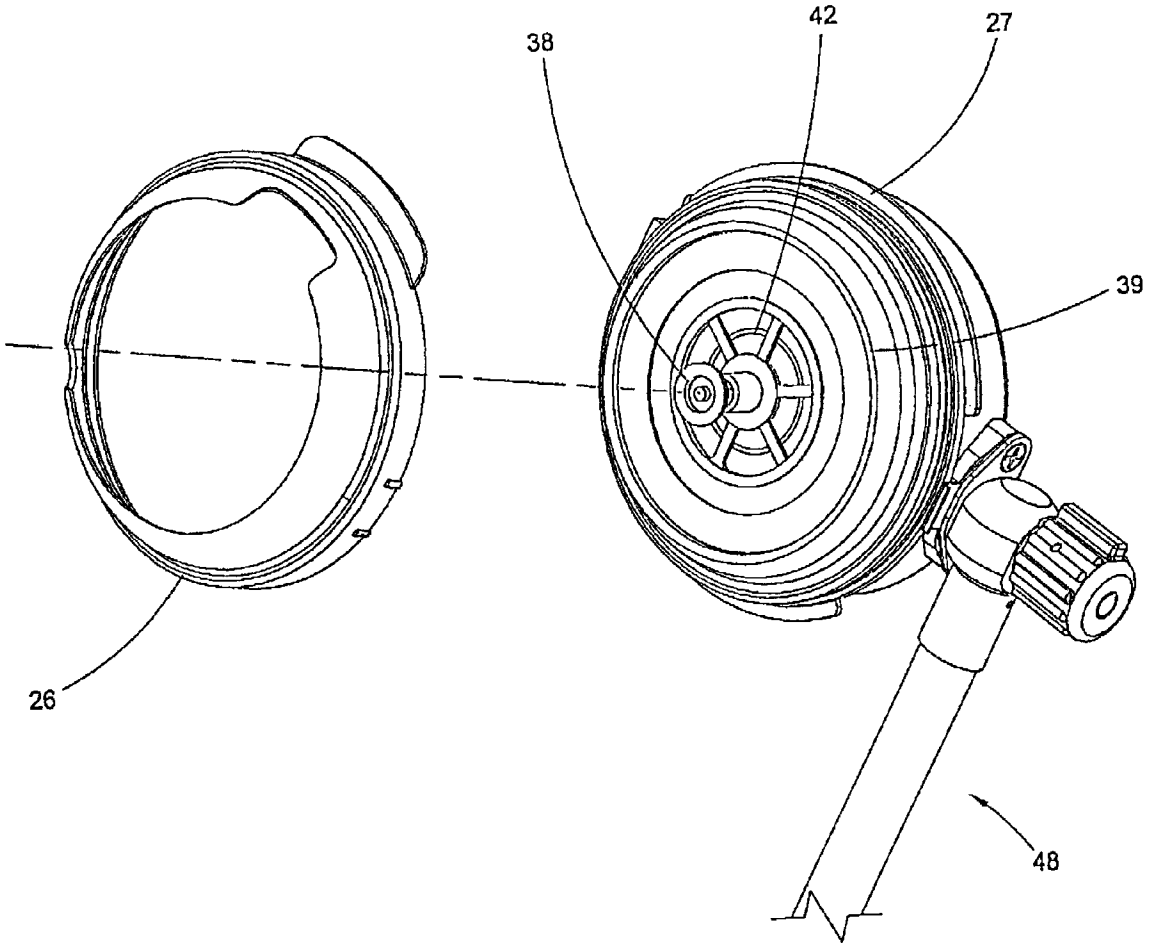
FIG. 5 is an exploded front perspective view of the breathing regulator of FIG. 2, with the cover sub-assembly removed, showing a diaphragm retaining ring and a diaphragm and valve assembly.

FIG. 4 is a top cross-sectional view of the breathing regulator 10 of FIG. 3B, taken along line 4-4, and FIG. 5 is a perspective view of the breathing regulator 10 of FIG. 2, with the cover sub-assembly 11 removed, showing the diaphragm and valve assembly 38. As shown therein, the breathing regulator 10 further includes a diaphragm retaining ring 26 and a sensing diaphragm and valve assembly 38. The diaphragm and valve assembly 38 functions as a unit comprised of a diaphragm assembly 39 and an exhalation valve assembly 42. The diaphragm retaining ring 26 covers the diaphragm and valve assembly 38, which is attached to the regulator body 27, creating a seal.

As shown in FIG. 4, the breathing regulator 10 may also include an exhalation valve seat 100, a regulator shroud 64, a hose swivel connector fitting 49, a valve and hose body 66, a diaphragm lever 67, a piston lever 68, a regulator purge knob 60, a valve stem 34, a probe pin 33, a ring retainer 74, a demand piston valve assembly 35, a valve tube support 62, a demand valve latch spring 63, a restrictor 31, a retaining ring 77, a guide 30, a gasket 72, a bearing 73, an alarm assembly 53, an o-ring 76, a regulator latch 70 and a non-linear positive pressure spring 25. Also as shown in FIG. 4, the hose assembly 48 may also include a ferrule 50, a supply hose 51 and a coupling plug 52. The design and function of each of these components will be apparent to one of ordinary skill in the art.

Figure 6:
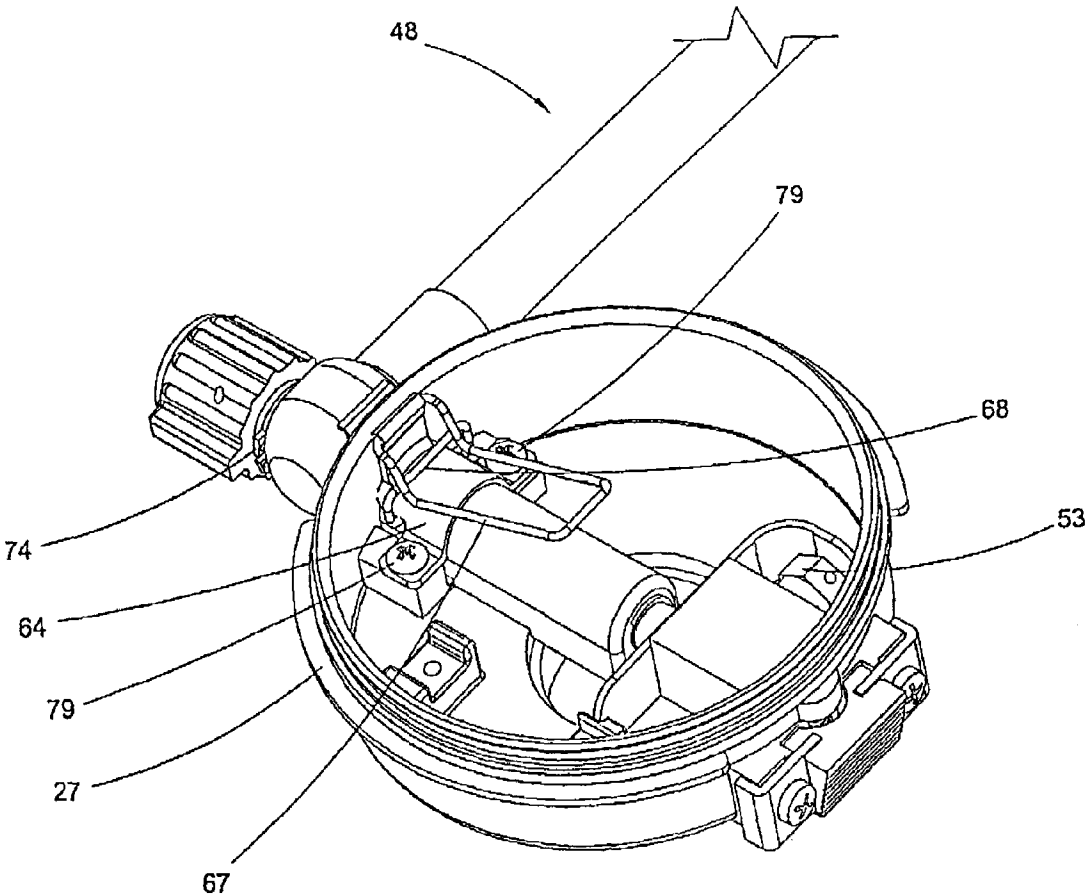
FIG. 6 is a front perspective view of the breathing regulator of FIG. 5 with the cover sub-assembly and the diaphragm and valve assembly removed.

FIG. 6 is a front perspective view of the breathing regulator 10 of FIG. 5 with the cover sub-assembly 11 and the diaphragm and valve assembly 38 removed. As shown in FIG. 6, the regulator body 27 comprises a demand valve piston assembly 35 (shown in FIG. 4), a diaphragm lever 67, a piston lever 68, and a hose assembly 48. As shown in FIG. 6, the breathing regulator 10 may also include a ring retainer 74, a tapping screw 79, a regulator shroud 64, and an alarm assembly 53. The design and function of each of these components will be apparent to one of ordinary skill in the art.

Figure 7:
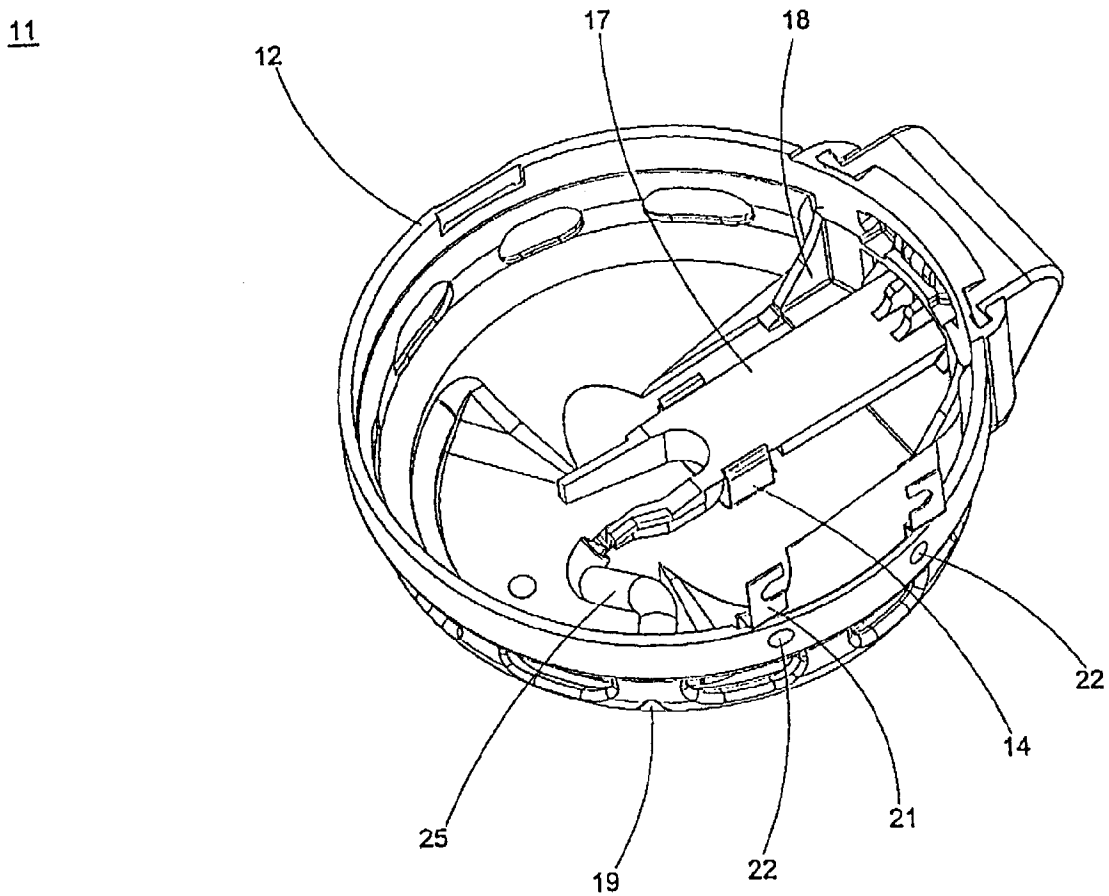
FIG. 7 is a rear perspective view of the cover sub-assembly.

FIGS. 7, 8A, 8B and 8C are rear perspective, front plan, rear plan, and side cross-sectional views, respectively, of the cover sub-assembly 11. The cover sub-assembly 11 of FIG. 7 covers the diaphragm retaining ring 26 of FIG. 5. As shown in FIG. 7, the cover sub-assembly 11 comprises an outer casing 12, a non-linear positive pressure spring 25, a retaining latch 14 and an air saver lever 17. In one embodiment, preferred for its utility in a wide range of environments, the breathing regulator 10 of the present invention is particularly suitable for use in a chemical, biological, radiological and nuclear ("CBRN") environment. In this embodiment, the outer casing 12 of the cover sub-assembly 11, shown in FIG. 7, is comprised of a material that can withstand a CBRN environment including, but not limited to, polyphenylene sulfide, polyphenylsulfone, polyetherimide, polyetheretherketone, and blends thereof. Particularly preferred materials include, but are not limited to, Radel® R-5000NT and Radel® R-5500NT commercially available from Solvay and ULTEM® commercially available from GE. Such a regulator will generally also require other specialized materials or features, as described further hereinbelow.

Figure 8B:
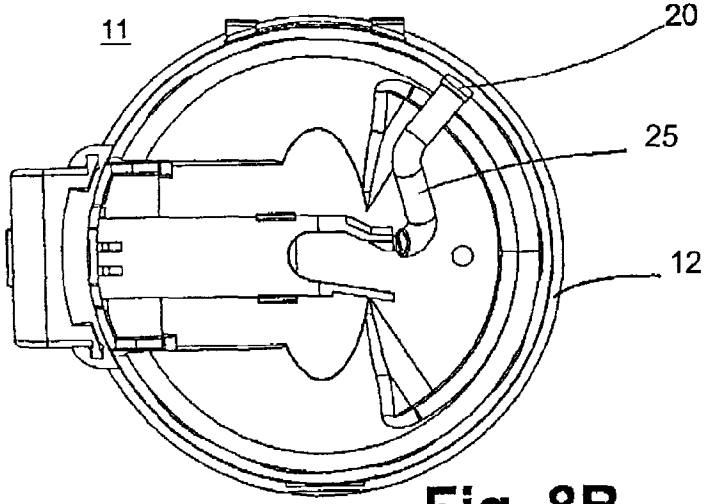
FIG. 8B is a rear plan view of the cover sub-assembly of FIG. 7.
Figure 8A:
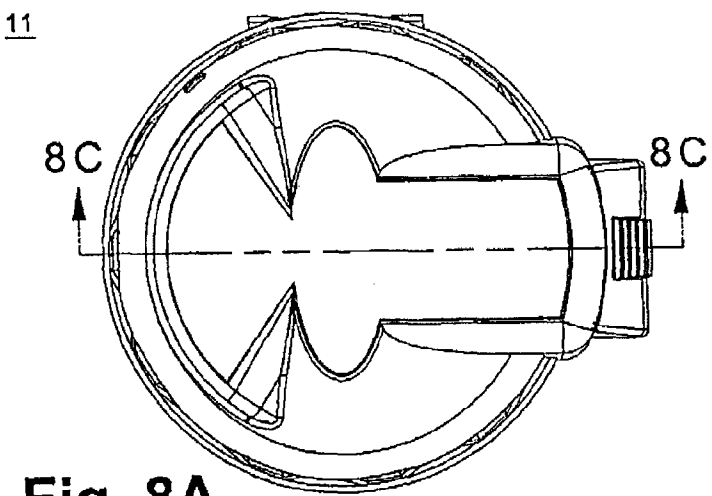
FIG. 8A is a front plan view of the cover sub-assembly of FIG. 7.

To place the regulator 10 in positive pressure mode and thereby prepare the regulator 10 for use, a person takes a first breath through the regulator 10. This first breath pulls the air saver lever 17 from the retaining latch 14 and switches the regulator 10 into positive pressure mode. Additionally, the non-linear positive pressure spring 25 is uncompressed. As shown in FIG. 7, the cover sub-assembly 11 may also include a bent spring mounting screw 19, a tubular rivet 22, a cover bracket 21 and a cover insert plug 18. As shown in FIG. 8B, the cover sub-assembly 11 may also include a bent spring mounting post 20, extending radially inward from the inner surface of the casing 12, which is inserted into one end of the spring 25. The design and function of each of these components will be apparent to one of ordinary skill in the art.

Figure 8C:
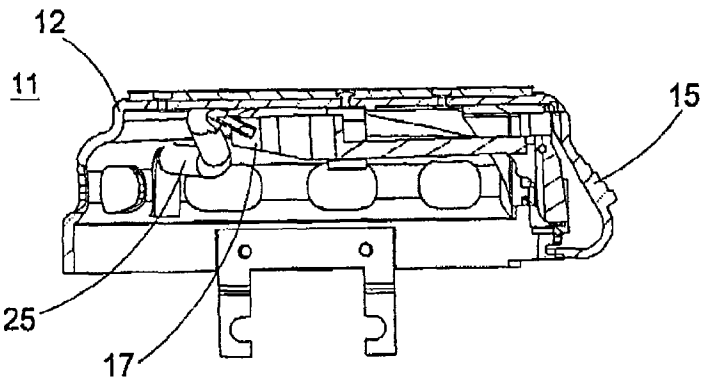
FIG. 8C is a side cross-sectional view of the cover sub-assembly of FIG. 8A taken along line 8C-8C.
Figure 9B:
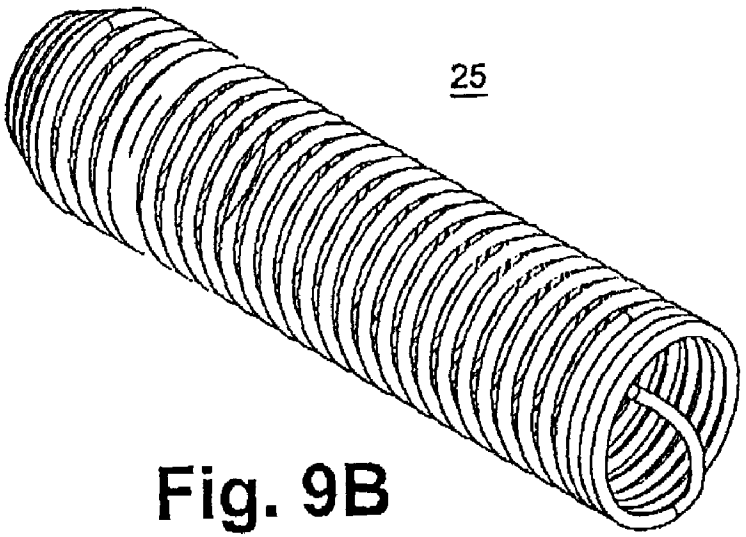
FIG. 9B is another perspective view of the non-linear positive pressure spring of FIG. 9A.
Figure 9A:
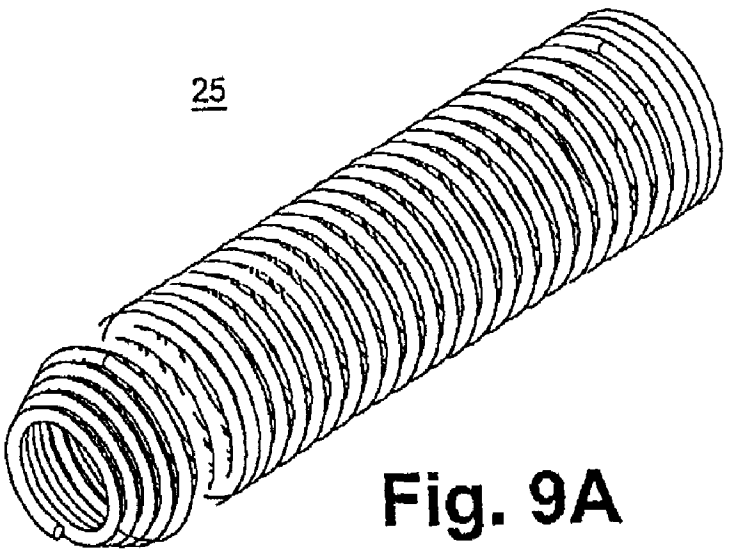
FIG. 9A is a perspective view of a non-linear positive pressure spring.
Figure 9C:
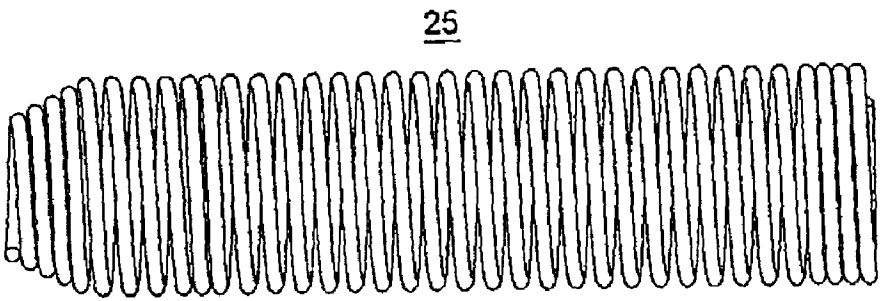
FIG. 9C is a side view of the non-linear positive pressure spring of FIG. 9A.

FIGS. 9A, 9B, and 9C are perspective and side views, respectively, of the non-linear positive pressure spring 25 of FIGS. 7, 8B and 8C. As will be appreciated by one of ordinary skill in the art, the spring 25 is shown only in schematic form in FIGS. 7, 8B and 8C. The term "non-linear" as used in the context of the present invention means that the deflection of the spring 25 is not directly proportional to the force applied to the spring 25, i.e., as force is applied to the spring 25, the force initially required will increase and then will decrease as the spring 25 is deflected. If the positive pressure spring 25 is non-linear as shown in FIGS. 9A, 9B and 9C, it has a load tolerance range of about ±7%.

The non-linear spring 25 of the present invention provides the benefit of easier breathing because of its location inside the breathing regulator 10 and because of its geometry. The location of the non-linear spring 25 is perhaps best shown in FIG. 7. The non-linear spring 25 is attached at one end to the wall of the breathing regulator 10 by the bent spring mounting post 20 (shown in FIG. 8B) and at the other end to the forked end of the air saver lever 17. By way of comparison, in a breathing regulator utilizing a linear spring, the spring is typically located under the air saver lever. As such, the linear spring exerts constant pressure on the air saver lever throughout exhalation, and the user must exert ever-increasing force in order to exhale.

The geometry of the non-linear spring 25 also aids in its functionality. As shown in FIGS. 9A, 9B, and 9C, the non-linear spring 25 has a conical shape at one end. The conical shape enables the non-linear spring 25 to be firmly attached to the bent spring mounting post 20. The other end of the non-linear spring 25 is tanged or bent to intersect the diameter of the spring. The tang enables the non-linear spring 25 to be firmly attached to the forked end of the air saver lever 17. The non-linear spring 25 also contains a region of dead coils interposed between the middle of the spring 25 and the conical end of the spring 25. The term "dead coils" as used in the context of the present invention means coils having no distance between them, i.e., coils placed directly in contact with another. The region of dead coils in the non-linear spring 25 provides no springing force because there is no space between the coils in this region. The dead coil region behaves in generally the same way that a solid metal cylinder would act. The dead coils are preferably disposed adjacent the free end of the mounting post 20 such that the body of the spring 25 is bent in the general region of the dead coils. The body of the spring 25 is also bent near where the spring 25 is connected to the air saver lever 17.

Figure 10A:
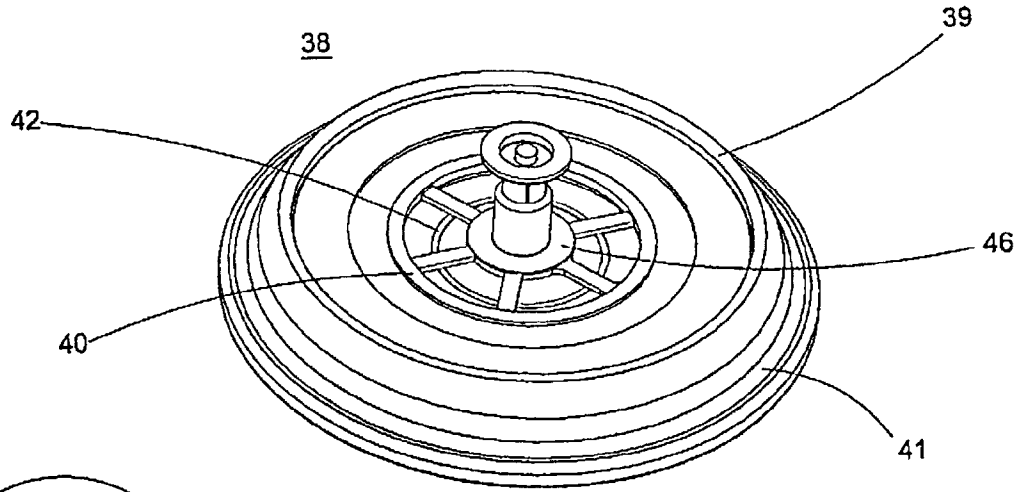
FIG. 10A is a front perspective view of the diaphragm and valve assembly of FIG. 5.
Figure 10B:
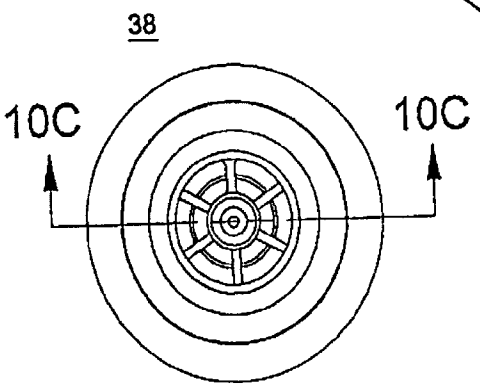
FIG. 10B is a front plan view of the diaphragm and valve assembly of FIG. 10A.
Figure 10C:
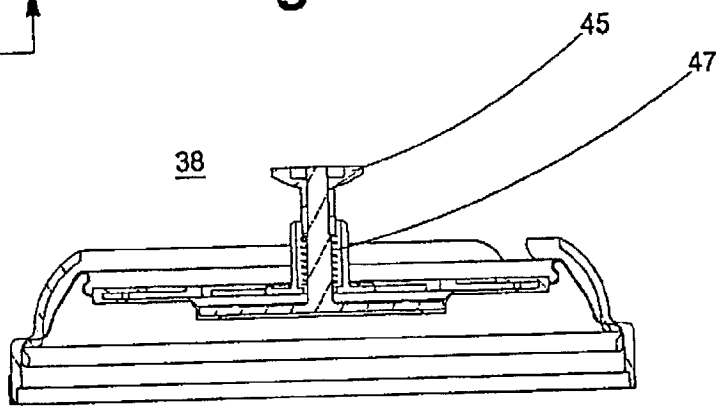
FIG. 10C is a side cross-sectional view of the diaphragm and valve assembly of FIG. 10B, taken along line 10C-10C.

FIGS. 10A, 10B and 10C are front perspective, front plan, and side cross-sectional views, respectively, of the diaphragm and valve assembly 38. As can be seen in FIG. 10A, in a preferred embodiment, the sensing diaphragm assembly 39 is comprised of a diaphragm plate 40 and a diaphragm 41. As shown in FIG. 10A, the diaphragm and valve assembly 38 may also include an antifriction washer 46. Also, as shown in FIG. 10C, the diaphragm and valve assembly 38 may also include a valve retainer 45 and a spring valve 47. The design and function of each of these components will be apparent to one of ordinary skill in the art.

In one embodiment, preferred for its utility in a wider range of environments, the sensing diaphragm assembly 39 is suitable for use in a CBRN environment. For example, the diaphragm may be formed from a butyl rubber material that provides protection against the CBRN environment, while maintaining the functional performance of the regulator and SCBA within NIOSH and NFPA specifications. A butyl rubber composition suitable for use in this embodiment is described in a commonly-assigned application being filed simultaneously with the present application entitled "CBRN (CHEMICAL, BIOLOGICAL, RADIOLOGICAL AND NUCLEAR) REGULATOR," the entirety of which is incorporated herein by reference. However, it will be apparent that, if the regulator 10 will not be used in a CBRN environment, other conventional materials, such as silicone and the like, may instead be used for the sensing diaphragm assembly 39 without departing from the scope of the present invention.

In a preferred embodiment of the present invention, the sensing diaphragm assembly 39 and the exhalation valve assembly 42 are connected as shown in FIG. 10A. The exhalation valve seat 100 (shown in FIG. 4) of the exhalation valve assembly 42 is preferably formed from silicone.

Figure 11:
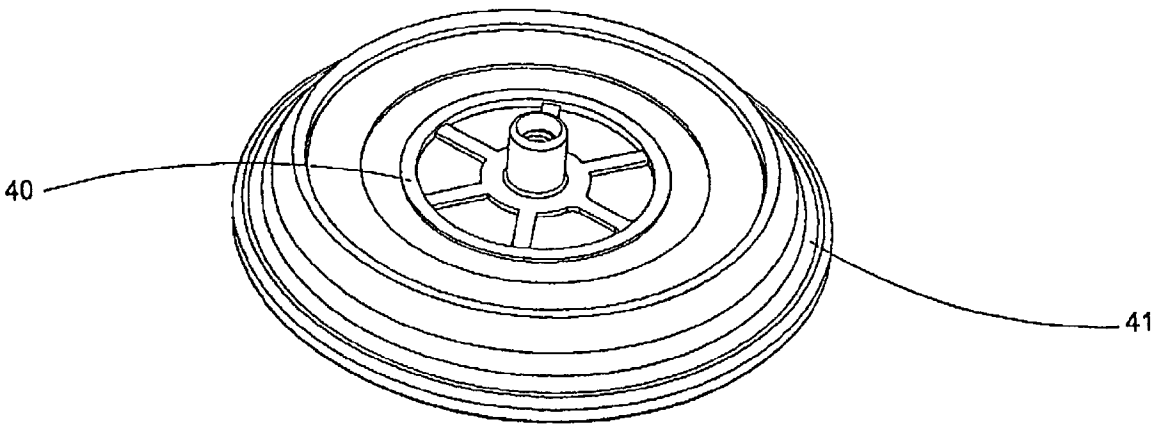
FIG. 11 is a front perspective view of the diaphragm assembly of FIG. 10A.
Figure 12:
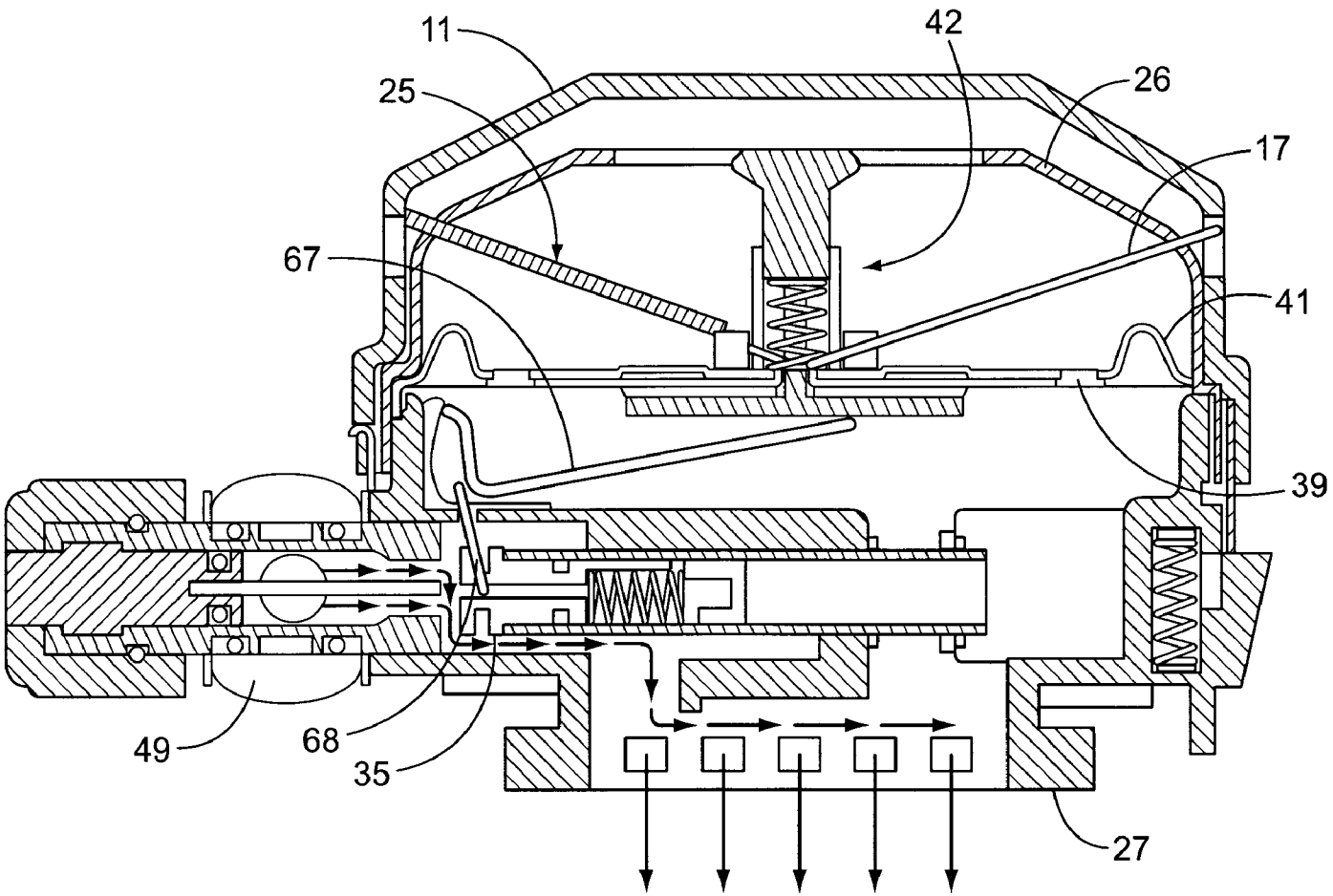
FIG. 12 is a cross-sectional schematic illustration of the breathing regulator of FIG. 2 during inhalation.
Figure 13:
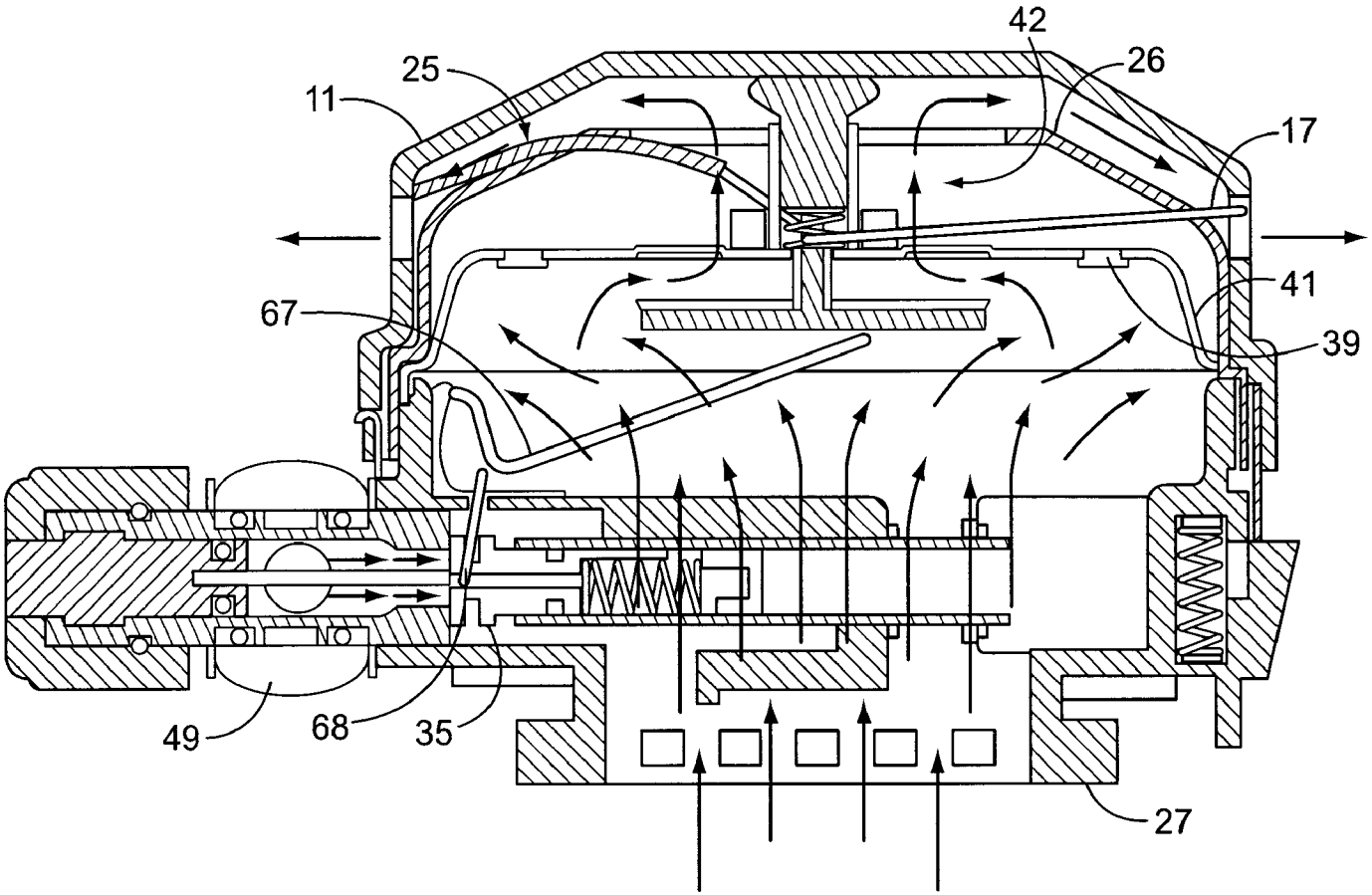
FIG. 13 is a cross-sectional schematic illustration of the breathing regulator of FIG. 2 during exhalation.

FIGS. 12 and 13 are cross-sectional schematic illustration of the breathing regulator 10 of FIG. 2 during inhalation and exhalation, respectively. The breathing regulator 10 functions differently upon inhalation and exhalation. During the breathing inhalation phase, a seal is formed between the exhalation valve assembly 42 (shown in FIG. 10A) and the sensing diaphragm assembly 39 (shown in FIGS. 10A and 11) such that they act as a unit. This is at least partially facilitated by the biasing effect of the non-linear spring 25, which, because of the relatively low pressure that exists during inhalation, remains in its static, relatively rigid position as shown in FIG. 12. Thus, the sensing diaphragm 41 and the exhalation valve assembly 42 deflate during the inhalation phase forcing the exhalation valve assembly 42 against the diaphragm lever 67 which in turn presses on the piston lever 68. The piston lever 68 then opens the demand valve piston assembly 35 to start the flow of air into the facepiece 6 via the hose 48, connector fitting 49 and regulator body 27.

During the breathing exhalation phase, if the user exhales with enough force to overcome the biasing force applied by the spring 25, then the sensing diaphragm 41 and exhalation valve assembly 42, once again acting as a unit, inflate, thereby causing the exhalation valve assembly 42 to press against the cover sub-assembly 11. The positive pressure forces the seal to open between the sensing diaphragm assembly 39 and the exhalation valve assembly 42 to expire the air. The expired air then exits to the atmosphere through expired air port holes 28 located in the cover sub-assembly 11. The demand valve piston assembly 35 remains closed during the entire exhalation phase. The inhalation and exhalation phases are repeated as long as the person is breathing.

Meanwhile, once enough force has been applied to the sensing diaphragm 41 to cause it to separate from the exhalation valve assembly 42, the non-linear spring 25 collapses, as illustrated schematically in FIG. 13. With regard to FIGS. 12 and 13, however, it should be noted that the shape of the spring 25 depicted therein is meant to be illustrative only, that the actual shape of the spring 25 is more accurately represented in FIGS. 4, 7 and 8B, and that the placement of the various components may likewise vary in FIGS. 12 and 13 as compared to the other views. As used herein, "collapse" of a spring refers to the effect created when the body of a spring that is under compression is bent sufficiently to cause the spring to begin to move out of compression. In the arrangement described and illustrated herein, collapse is caused by maintaining a relatively constant orientation of the ends of the spring 25 and then shifting the axis of one of the spring 25 relative to the axis of the other end of the spring until sufficient displacement is reached to cause the spring 25 to collapse. Grooves (not shown) may be used on the air saver lever 17 and the mounting post 20 to preserve the axes of the respective ends of the spring 25. Collapse is thus caused by a combination of the compression of the spring, the bending moment created and the torsional effect on the spring. However, it should be apparent that a spring 25 may otherwise be caused to collapse in other ways, such as through the use of a "spring break" mechanism (not illustrated) wherein the body of the spring is forced laterally against a fulcrum or similar structure so as to displace the middle of the body of the spring sideways, thereby causing its collapse. Other, more sophisticated non-linear springs may also be substituted without departing from the scope of the present invention.

In any event, once collapsed, the non-linear spring 25 offers no resistance to the opening of the exhalation valve assembly 42. Thus, in order to exhale freely, a user must simply exhale with enough force to overcome the biasing force of the spring 25 and cause the spring 25 to collapse, at which point the user experiences only a small amount of resistance. By using the non-linear positive pressure spring 25, the breathing regulator 10 of the present invention is advantageous relative to conventional breathing regulators, which utilize linear springs, because it makes breathing easier for the user. This is particularly useful because of the physically demanding nature of the activity typically being performed by the person wearing the SCBA and the environment in which the activity is performed. The breathing benefits of a non-linear positive pressure spring are a result of its resistance force not being directly proportional to its deflection. In a breathing regulator that utilizes a non-linear positive pressure spring, the user's exhalation resistance is lowered as a result of the location and the design of the non-linear spring, as described below.

Figure 14:
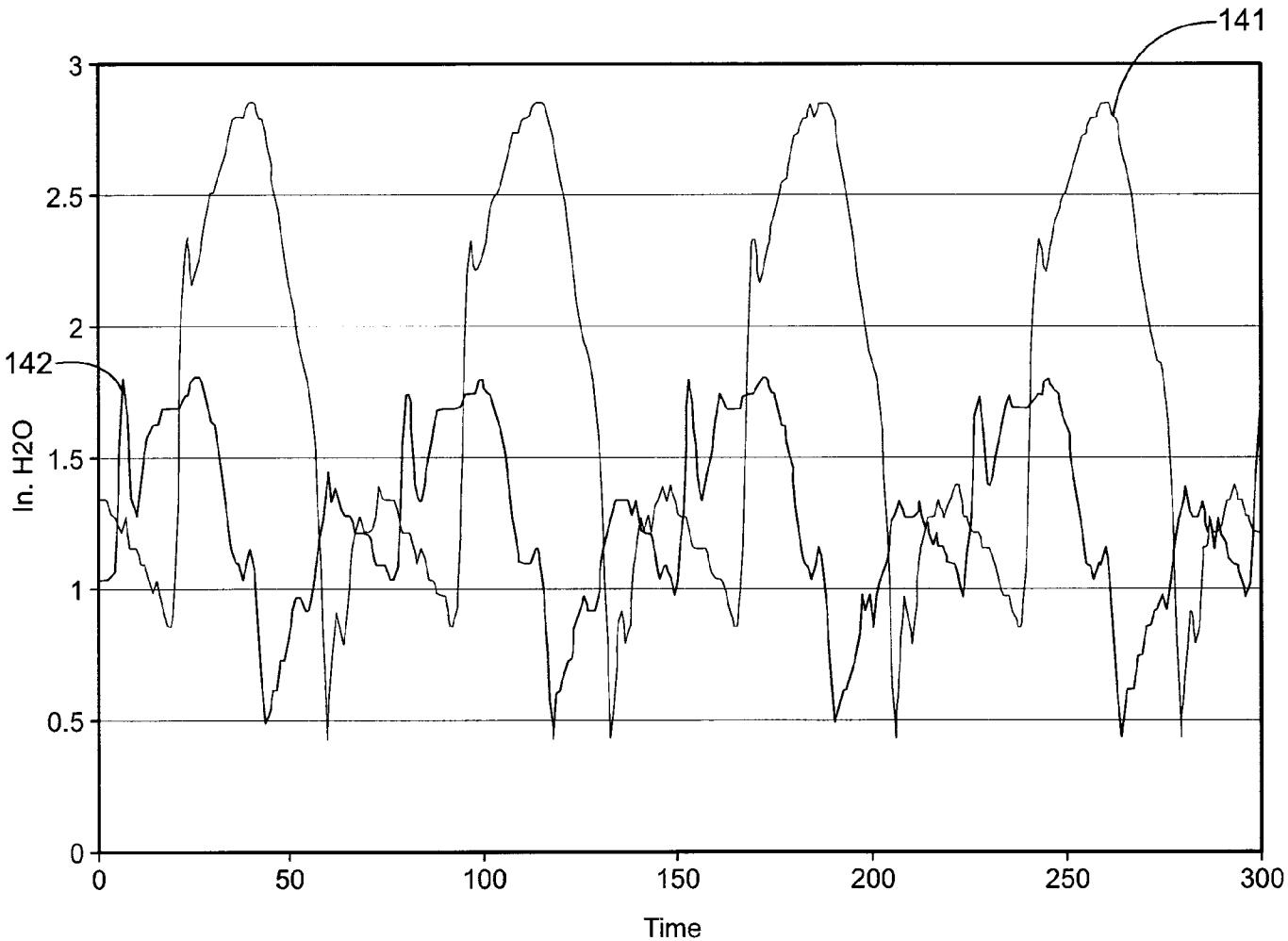
FIG. 14 is a graphical illustration comparing the operation of the breathing regulator of FIG. 2 to the operation of a conventional breathing regulator (i.e., one that utilizes a linear positive pressure spring) during several consecutive exemplary inhalation-exhalation cycles.

FIG. 14 is a graphical illustration comparing the operation of the breathing regulator 10 of FIG. 2 to the operation of a conventional breathing regulator (i.e., one that utilizes a linear positive pressure spring) during several consecutive exemplary inhalation-exhalation cycles. Two cyclical traces 141, 142 are shown in FIG. 14, each representative of the pressure inside a facepiece, such as the facepiece 6 of the present invention, over a period of time. The first trace 141 reflects the use of a conventional breathing regulator using a linear spring, while the second trace 142 reflects the use of the breathing regulator 10 of the present invention. In the traces 141, 142, each of which represents approximately four complete breathing cycles, increased pressures occur during exhalation, while decreased pressures occur during inhalation. In both traces 141, 142, the pressure during inhalation is approximately the same, dropping to approximately 0.4 or 0.5 inches of water column. However, in the first trace 141, a very marked and relatively linear increase (from approximately 1.8 inches to approximately 2.8 inches) occurs at the beginning of the exhalation phase of each breathing cycle, while in the second trace 142, the pressure increases only from approximately 1.0 inch to 1.8 inches, and after a brief drop stabilizes at that level before dropping off during inhalation.

Figure 15:
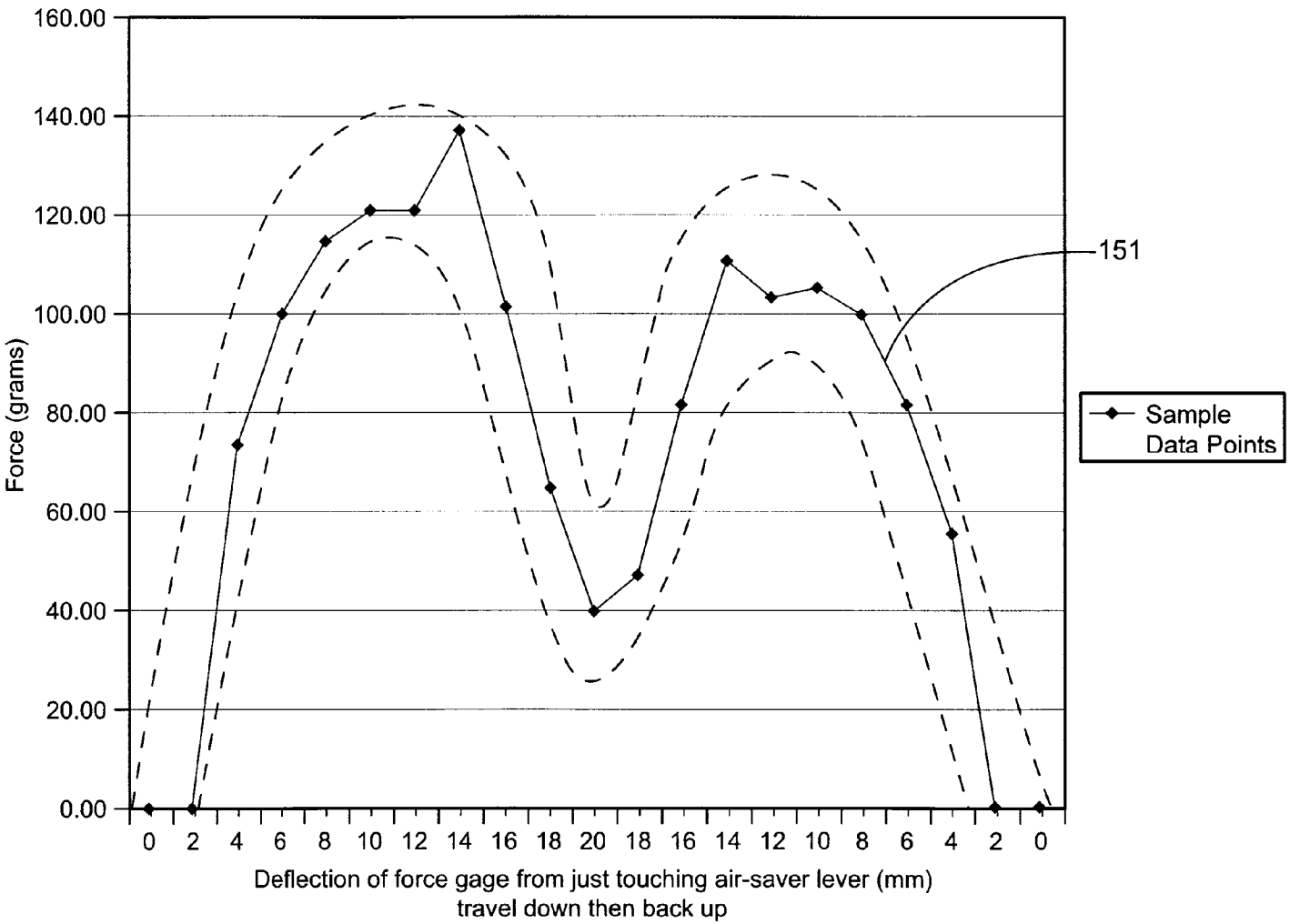
FIG. 15 is a graphical illustration of the relationship between force applied to the air saver lever of FIGS. 12 and 13 and the amount of deflection caused thereby.

FIG. 15 is a graphical illustration of the relationship between force applied to the air saver lever 17 of FIGS. 12 and 13 and the amount of deflection caused thereby. The curve 151 plotted in FIG. 15 represents a series of sample data points collected during testing of a sample of the breathing regulator 10 of FIG. 2. Notably, the x-axis of the graph progresses first from 0 to 20 mm of deflection, representative of the travel of the air saver lever 17 in one direction, followed by a progression of from 20 to 0 mm of deflection as the air saver lever 17 travels in the opposite direction. As demonstrated by the graph, a relatively linear relationship exists between the amount of force required to cause deflection of the end of the air saver lever 17 of between 2 and 14 mm. However, significant additional deflection may be achieved with much less force, as shown in the steep downward curve from 14 mm to 20 mm of deflection. A fairly symmetrical curve is then achieved as the deflection of the air saver lever 17 is then reduced from 20 mm of deflection back to 0 mm.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A breathing regulator comprising:

a housing;

a diaphragm assembly disposed within the housing, the diaphragm assembly being movable within the housing between a sealed position and an unsealed position wherein fluid within the housing passes by the diaphragm assembly; and a non-linear positive pressure spring, operably connected between the diaphragm assembly and the housing and arranged to exert a non-linear biasing force on the diaphragm assembly when moved over a spring range of motion during an exhalation phase of a breathing cycle, the non-linear positive pressure spring exerting different first and second biasing forces on the diaphragm assembly when at different first and second points along the spring range of motion during the exhalation phase of the breathing cycle.

2. The breathing regulator of claim 1, wherein the non-linear positive pressure spring is arranged to maintain the diaphragm assembly in the sealed position during an inhalation phase of the breathing cycle and to permit the diaphragm assembly to move to the unsealed position when the air pressure achieved during the exhalation phase of the breathing cycle is sufficient to overcome the biasing force applied by the spring.

3. The breathing regulator of claim 1, wherein the amount of force required to maintain the diaphragm assembly in the unsealed position is less than the amount of force required to move the diaphragm assembly to the unsealed position.

4. The breathing regulator of claim 1, wherein the non-linear positive pressure spring is a coil spring arranged to collapse or buckle when a sufficient amount of force is applied thereto.

5. The breathing regulator of claim 4, wherein movement of the sensing diaphragm from the sealed position causes the spring to compress until a predetermined position is reached, at which point further movement of the sensing diaphragm causes the spring to collapse.

6. The breathing regulator of claim 5, wherein the point at which further movement of the sensing diaphragm causes the spring to collapse is reached when a central region of the spring is displaced relative to the ends of the spring by an amount sufficient to cause the spring to begin to fall out of compression.

7. The breathing regulator of claim 1, wherein the housing includes a mounting post on which one end of the spring is retained.

8. The breathing regulator of claim 1, wherein the non-linear positive pressure spring is a coil spring and the coil is connected between the diaphragm assembly and the housing and arranged such that the body of the coil includes a first bend near its interconnection with the housing and a second bend near its interconnection with the diaphragm assembly.

9. The breathing regulator of claim 1, further comprising an air saver lever interconnected between one end of the spring and the diaphragm assembly.

10. The breathing regulator of claim 1, wherein the spring range of motion extends from the first point to the second point, the diaphragm assembly being movable within the housing from the sealed position to a fully unsealed position wherein fluid passing by the diaphragm assembly is at peak flow, the diaphragm assembly being in the sealed position when the non-linear positive pressure spring is at the first point along the spring range of motion, the diaphragm assembly being in the fully unsealed position when the non-linear positive pressure spring is at the second point along the spring range of motion.

11. The breathing regulator of claim 1, wherein the diaphragm assembly is movable within the housing to a fully unsealed position wherein fluid passing by the diaphragm assembly is at peak flow, the diaphragm assembly being in the fully unsealed position when the non-linear positive pressure spring is at the second point along the spring range of motion.

12. The breathing regulator of claim 1, wherein the non-linear biasing force of the non-linear positive pressure spring is non-snap action.

13. An air supplied respirator having a breathing regulator comprised of:

a housing;

a diaphragm assembly disposed within the housing; and a non-linear positive pressure spring, operably connected between the diaphragm assembly and the housing and arranged to bias the diaphragm assembly in a sealed position within the housing, wherein the non-linear positive pressure spring is a coil spring arranged to collapse when a sufficient amount of force is applied thereto.

14. The air supplied respirator of claim 13, wherein the non-linear positive pressure spring is arranged to maintain the diaphragm assembly in the sealed position during an inhalation phase of a breathing cycle and to permit the diaphragm assembly to move to an unsealed position when the air pressure achieved during an exhalation phase of the breathing cycle is sufficient to overcome the biasing force applied by the spring.

15. The air supplied respirator of claim 13, wherein the amount of force required to maintain the diaphragm assembly in an unsealed position is less than the amount of force required to move the diaphragm assembly to the unsealed position.

16. The air supplied respirator of claim 13, wherein the housing includes a mounting post on which one end of the spring is retained.

17. The air supplied respirator of claim 13, wherein movement of the sensing diaphragm from the sealed position causes the spring to compress until a predetermined position is reached, at which point further movement of the sensing diaphragm causes the spring to collapse.

18. The air supplied respirator of claim 17, wherein the point at which further movement of the sensing diaphragm causes the spring to collapse is reached when a central region of the spring is displaced relative to the ends of the spring by an amount sufficient to cause the spring to begin to fall out of compression.

19. The air supplied respirator of claim 13, wherein the coil is connected between the diaphragm assembly and the housing and arranged such that the body of the coil includes a first bend near its interconnection with the housing and a second bend near its interconnection with the diaphragm assembly.

20. The air supplied respirator of claim 13, further comprising an air saver lever interconnected between one end of the spring and the diaphragm assembly.

* * * * *